United States Patent [19]

Hallberg

[11] 4,305,892

[45] Dec. 15, 1981

[54] CARBURETOR

[75] Inventor: Irving H. Hallberg, Des Plaines, Ill.

[73] Assignee: Borg-Warner Corporation, Chicago, Ill.

[21] Appl. No.: 198,505

[22] Filed: Oct. 20, 1980

Related U.S. Application Data

[63] Continuation of Ser. No. 64,665, Aug. 8, 1979, abandoned.

[51] Int. Cl.[3] ..... F02M 9/12

[52] U.S. Cl. ..... 261/36 A; 261/41 R; 261/44 H; 261/62; 261/65

[58] Field of Search ..... 261/36 A, 44 H, 62, 261/65, 41 R

[56] References Cited

U.S. PATENT DOCUMENTS

| | | | |
|---|---|---|---|
| 1,222,672 | 4/1917 | Reichenbach . | |
| 2,709,579 | 5/1955 | Sykes | 261/41 R |
| 2,962,015 | 11/1960 | Serruys et al. . | |
| 3,334,876 | 8/1967 | Shorrock . | |
| 3,336,014 | 8/1967 | Shorrock | 261/44 F |
| 3,752,451 | 8/1973 | Kendig | 261/44 F |
| 3,785,627 | 1/1974 | Tuzson et al. | 261/36 A |
| 3,969,445 | 7/1976 | Vogelsang | 261/44 F |
| 4,066,721 | 1/1978 | Graham | 261/62 |

FOREIGN PATENT DOCUMENTS 2820438 11/1978 Fed. Rep. of Germany ... 261/36 A

*Primary Examiner*—Tim R. Miles
*Attorney, Agent, or Firm*—Aubrey L. Burgess

[57] ABSTRACT

Charge forming apparatus such as a carburetor of the fluid jet type in which fuel is supplied to a pair of tubular members, which may be of equal or different diameters, disposed across a housing opening through which air flows, the velocity of which is controlled by a throttle valve or damper means. Each tubular member is constructed with a generally upwardly directed slot or fuel gap, such that the air strips fuel therefrom. Excess fuel from the tubular members is returned to the source. In the specific apparatus, one tubular member is located upstream in the housing from the other, the lower tubular member being located closely adjacent to the location of initial opening of the air throttle valve or damper. The throttle valve or damper may be of the iris type or of the type having a pair of vanes pivoted outwardly of the center thereof, so as to initially open at the center thereof.

At small throttle openings, air flowing to the engine is concentrated over the fuel gap of the lower member. This results in high air velocities at low air flow rates, which will provide sufficient fuel being stripped from the slots for the engine at idle and light loads.

7 Claims, 3 Drawing Figures

CARBURETOR

This is a continuation of application Ser. No. 064,665 filed Aug. 8,1979, now abandoned.

BACKGROUND OF THE INVENTION

Recirculating fuel systems for forming a fuel-air mixture of the type in which a stream of induced air impinges upon a stream of fuel in a fuel dispersion gap or opening and wherein the air strips fuel from the stream are known in the art. For example, U.S. Pat. Nos. 3,785,627 granted to Tuzson, Hallberg and Vaughn on Jan. 15, 1974; 3,977,382 granted to Tuzson and Hallberg on Aug. 31, 1976; and 4,130,610 granted to Paul on Dec. 19, 1978 are examples of such fuel systems or charge forming apparatus. Each of the patents describe apparatus in which a throttle member controls the velocity of the air stream, which throttle member is of the peripheral opening type, i.e., the throttle member pivots about a diameter thereof; and the tubular member with the gap through which fuel is supplied is spaced above the opening zone of the throttle member.

THE INVENTION

In the invention of this application, a charge forming apparatus of the fluid jet type comprises a throttle means of the central opening type or of the iris type, with a first fuel supply member of the tubular type having a generally upwardly directed fuel gap or slot positioned closely adjacent to the initial opening zone of the throttle means and a second fuel supply member of the same tubular type located upstream of the first tubular member. The throttle means may comprise a pair of vanes each pivoted to open at the center of the tubular member. Both fuel supply members have fuel stripped from their fuel gaps or slots by the air flowing through the housing member, the throttle, by its opening, controlling the velocity of the air through the housing to the engine.

The two fluid jet tubes provide a means for achieving a greater flexibility in setting a desired fuel-air curve. In the preferred embodiment, the first jet tube, the one near the initial throttle opening, has a relatively small I.D. and thus a small capacity. The second jet tube is located a greater distance from the throttle member. At this location, the fuel gap of the second jet tube will be exposed to an average air velocity for the bore or throttle opening.

At low air flow rates, which occur at idle and light load conditions, fuel is supplied mainly by the first jet tube which sees a relatively high velocity air flow because of its proximity to the throttle opening. The amount of fuel supplied at idle and light loads can thus be varied by adjusting the fuel gap or slot size of the first jet tube. Under such conditions, the second jet tube supplies little, if any, fuel because of the low average air velocity over its fuel gap. As the air velocity increases, the second fuel jet tube begins to supply fuel with the rate increasing in proportion to the air flow. Changes in the gap of the first jet tube will have a small influence on the fuel-air rates at the higher air flow rates.

In addition to providing a high air velocity over the jet gap of the lower jet tube at idle and light loads, the central throttle opening provides better atomization and distribution of fuel because the fuel enters the air stream centrally rather than near the housing walls as with conventional butterfly throttles.

THE DRAWING

DETAILED DESCRIPTION

Figure 1:
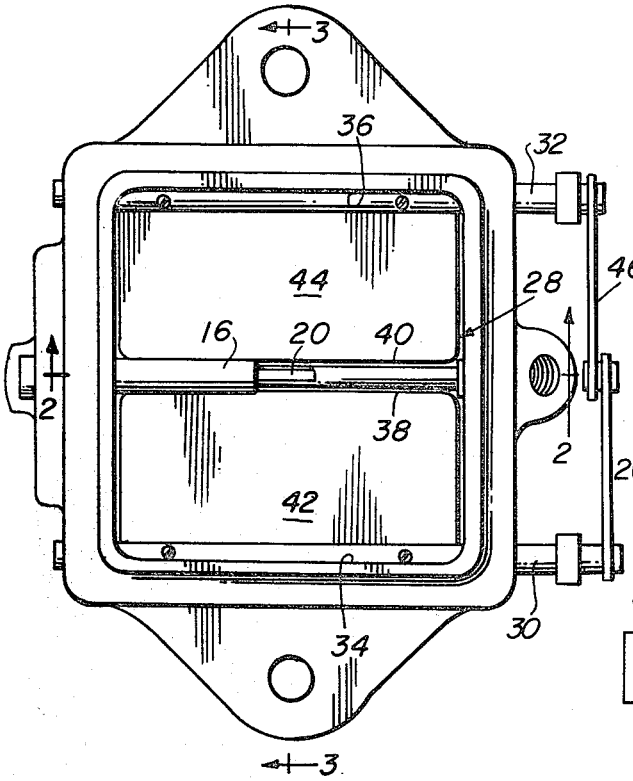
FIG. 1 is a plan view of a carburetor according to this invention.
Figure 2:
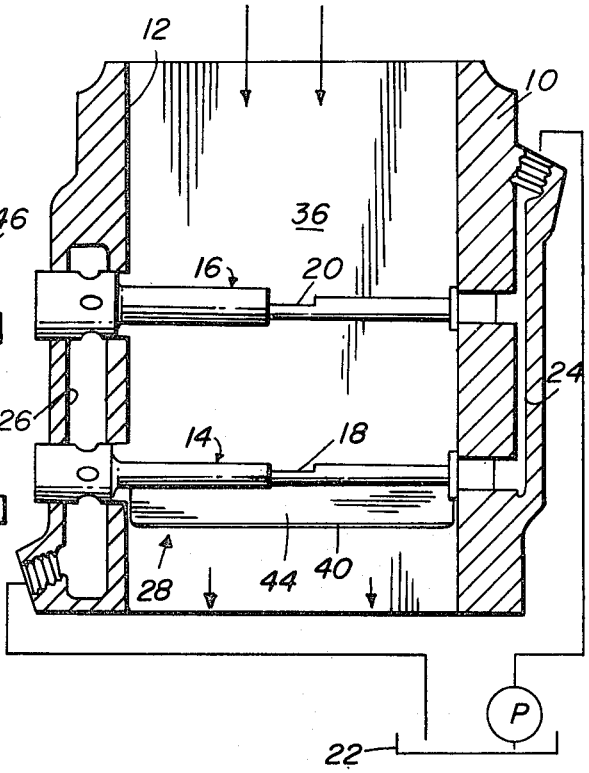
FIG. 2 is a sectional view taken on line 2—2 of FIG. 1.
Figure 3:
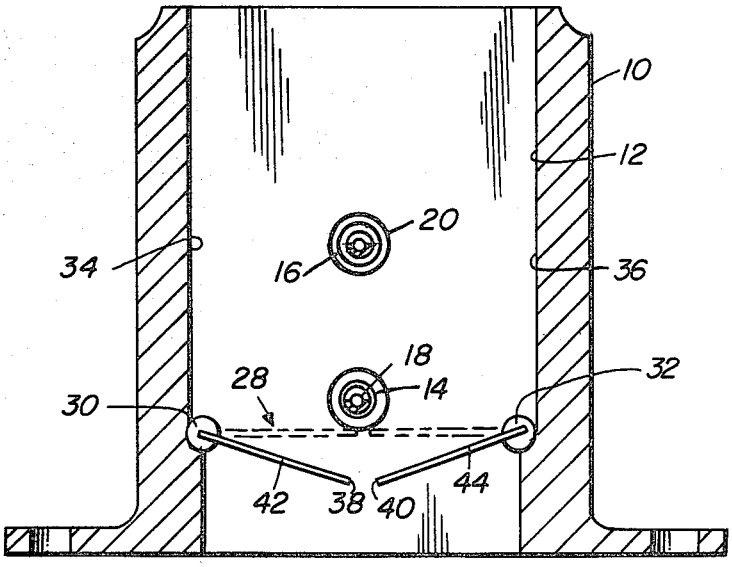
FIG. 3 is a sectional view taken on line 3—3 of FIG. 1 showing, in addition by broken lines the throttle valve in closed position.

The drawing shows a rectangular housing 10 having an opening 12 through which air flows in the direction of the arrows from an air cleaner (not shown) to the engine of an automobile (also not shown). A pair of jet tubes 14 and 16 are vertically spaced and aligned one above the other and traverse the opening 12. These jet tubes are similar in construction to those described in the before referred to patents. Each tube is constructed of telescoping parts and provided with an upwardly directed slot 18 and 20, respectively, to expose a stream of fuel to the air flowing through the opening 12. The fuel is pumped by a fuel pump P from a source 22 to a manifold 24 formed in the housing 10 which communicates with the tubes 14 and 16. Fuel is stripped from the upwardly directed slots 18 and 20 by the air flowing through the opening 12. Excess fuel flows to a manifold 26 formed in the body 10 and back to the source 22.

The length of each slot 18 and 20 and thus the amount of fuel exposed to the stream of air can be adjusted as in the prior patents by moving one part of each tube with respect to another part.

The velocity of air flowing through the opening 12 is controlled by a throttle valve 28 which opens from the center, being pivoted as at 30 and 32 adjacent opposite defining walls 34, 36, respectively, of the opening 12. The lower jet tube 14 is located closely adjacent to the location of initial opening of the valve 28 and is positioned substantially parallel to the inward edges 38, 40 of its vanes 42, 44, respectively. Linkage means 46 are suitably connected to means, not shown, to control the vanes 42,44.

In the embodiment illustrated, which is the preferred embodiment, the lower jet tube 14 is of smaller diameter than the upper jet tube 16. A similar effect can be achieved by changing the lengths of the slots 18 and 20, such that the quantity of fuel stripped from the lower tube A is less than that from the top or upper tube 16. Both fuel slots 18 and 20 have fuel stripped therefrom by the air flowing through the housing member 10, the throttle 28 controlling the velocity of the air to the engine.

As an alternative, the throttle valve can be constructed as an iris, i.e., a plurality of blades which open from the center and which can define various size openings.

The two fluid jet tubes 14 and 16 provide a means for achieving a great flexibility in setting a desired fuel-air curve. In the preferred embodiment, the first jet tube 14, the one near the initial throttle opening, has a relatively small I.D. and thus a small capacity. The second jet tube 16 is located a greater distance from the throttle member 28. At this location, the fuel gap 20 of the second jet tube 16 will be exposed to an average air velocity for the bore or throttle opening At low air flow rates, which occur at idle and light load conditions, fuel is supplied mainly by the first jet tube 14 which sees a relatively high velocity air flow because of its proximity to the throttle opening. The amount of fuel supplied at idle and light loads can thus be varied by adjusting the length of the fuel gap or slot 18 of the first jet tube 14. Under such conditions, the second jet tube 16 supplies little, if any fuel, because of the low average air velocity over its fuel gap 20. As the air velocity increases, the second fuel jet tube 16 begins to supply fuel with the rate increasing in proportion to the air flow. Changes in the gap 18 of the first jet tube 14 will have a small influence on the fuel-air rates at the higher flow rates because most of the fuel has been deflected to the engine at moderate air flow.

In addition to providing a high air velocity over the jet gap of the first tube 14 at idle and light loads, the central throttle opening provides better atomization and distribution of fuel because the fuel enters the air stream centrally rather than near the housing walls as with conventional butterfly throttles.

I claim:

1. In a charge forming apparatus where fuel is supplied from a source to a member positioned across a housing passageway through which air flows and where said member has a generally upwardly facing slot over which the air flows and strips fuel from the slot, excess fuel returning to said source, the velocity of said air flow being controlled by valve means in said passageway; the improvement comprising:

spaced first and second members connected to said source of fuel and each having an upwardly facing slot to expose fuel to said air flow;

said first member being located upstream of and closely adjacent to said valve means and to an initial opening position thereof; and said second member being located upstream of said first member;

said valve means being the sole means for controlling the velocity of said air and being so constructed and arranged to open initially from a completely closed central position and to provide a concentrated and relatively high velocity air flow over said first member when at the initial and small opening and a less concentrated and relatively lower velocity air flow over said first and second members at larger openings.

2. In a charge forming apparatus as recited in claim 1 in which said valve means comprises a pair of pivotable vanes to provide a generally central opening in said housing passageway, said vanes being pivotable from completely closed to open positions.

3. In a charge forming apparatus as recited in claim 1 in which said first member is of a smaller diameter than said second member.

4. In a carburetor where fuel is supplied from a source to a member positioned across a housing passageway through which air flows and where said member has a generally upwardly facing slot exposing fuel to air flow which strips fuel from said slot, excess fuel returning to said source, the velocity of said air flow being controlled by valve means in said passageway, the improvement comprising:

spaced first and second members connected to said source of fuel with each member having an upwardly facing slot to expose fuel to said air flow;

said housing passageway being substantially rectangular in section;

said valve means comprising a pair of vanes having free edges parallel to opposite walls of said passageway and opposite edges pivoted about pivots located at opposing walls of said passageway;

said first member being located upstream of and closely adjacent to said valve means and to an initial opening location thereof; and said second member being located upstream and above said first member;

said valve means being the sole means for controlling the velocity of said air and being so constructed to open initially from a completely closed central position; and to provide a concentrated and relatively high velocity air flow over said first member when at its initial and small opening and a less concentrated and relatively lower velocity air flow over said first and second members at larger openings.

5. In a carburetor as recited in claim 4, wherein said first and second members are parallel to one another and to the free edges of said vanes.

6. In a carburetor as recited in claim 4 wherein said first and second members have different diameters.

7. In a carburetor as recited in claim 6 wherein the diameter of said first member is smaller than that of said second member.

* * * * *